US011953231B2

(12) United States Patent
Milchsack et al.

(10) Patent No.: US 11,953,231 B2
(45) Date of Patent: Apr. 9, 2024

(54) HEATING DEVICE

(71) Applicant: Viessmann Climate Solutions SE, Allendorf (DE)

(72) Inventors: Frank Milchsack, Biedenkopf (DE); Isabel Seipp, Allendorf (DE); Peter Haffner, Hatzfeld (DE); Sven Hommel, Frankenberg (DE); Lars Paesler, Marburg (DE); Christian Wieser, Wetter (DE)

(73) Assignee: Viessmann Climate Solutions SE, Allendorf (DE)

( * ) Notice: Subject to any disclaimer, the term of this patent is extended or adjusted under 35 U.S.C. 154(b) by 0 days.

(21) Appl. No.: 17/856,017

(22) Filed: Jul. 1, 2022

(65) Prior Publication Data

US 2024/0003592 A1 Jan. 4, 2024

(51) Int. Cl.
*F24H 1/40* (2022.01)
*F24H 1/43* (2022.01)

(52) U.S. Cl.
CPC ..... *F24H 1/43* (2013.01)

(58) Field of Classification Search
CPC . F24H 1/40; F24H 1/16; F24H 1/0036; F24H 1/165; F24H 1/43; F24H 1/12; F24H 1/403
See application file for complete search history.

(56) References Cited

U.S. PATENT DOCUMENTS

| | | | | | |
|---|---|---|---|---|---|
| 2,656,821 | A * | 10/1953 | Ray | F22B 17/16 | 122/410 |
| 3,704,748 | A * | 12/1972 | Hapgood | F28F 13/003 | 122/501 |
| 7,281,497 | B2 * | 10/2007 | Le Mer | F24H 9/2035 | 122/18.1 |
| 7,302,916 | B2 * | 12/2007 | LeMer | F24H 1/43 | 122/15.1 |
| 10,030,915 | B2 * | 7/2018 | Alessandrini | F24H 1/43 | |
| 10,575,434 | B2 * | 2/2020 | Van Vliet | F28F 9/0131 | |
| 10,612,776 | B2 * | 4/2020 | Ono | F23D 14/36 | |
| 10,900,691 | B2 * | 1/2021 | Giannoni | F24H 1/43 | |
| 2006/0196450 | A1 | 9/2006 | Le Mer et al. | | |
| 2022/0341684 | A1 * | 10/2022 | Le Mer | F24H 8/00 | |

FOREIGN PATENT DOCUMENTS

| | | | | |
|---|---|---|---|---|
| DE | 42 01 687 | A1 | 8/1993 | |
| DE | 102014107844 | B3 * | 12/2015 | F22B 21/26 |
| DE | 202014010537 | U1 * | 1/2016 | F22B 21/26 |
| EP | 3 540 325 | B1 | 7/2020 | |

* cited by examiner

*Primary Examiner* — Gregory A Wilson
(74) *Attorney, Agent, or Firm* — Collard & Roe, P.C.

(57) ABSTRACT

A heating device includes a housing closed with a cover element and enclosing a combustion chamber, wherein an opening for receiving a burner device pointing into the combustion chamber is provided on the cover element, wherein the opening is delimited by a first cylindrical sheet section of the cover element (1), wherein the first sheet section is connected to a second sheet section of the cover element so as to face away from the combustion chamber. The second sheet section extends radially outwards as a contact flange for the burner device.

11 Claims, 2 Drawing Sheets

HEATING DEVICE

BACKGROUND OF THE INVENTION

1. Field of the Invention

The invention relates to a heating device.

2. Description of the Related Art

A heating device of the type mentioned at the start is known from patent document EP 3 540 325 B1. This heating device consists of a housing closed with (at least) a cover element and enclosing a combustion chamber, wherein an opening for receiving a burner device pointing into the combustion chamber is provided on the cover element, wherein the opening is delimited by a first cylindrical sheet section of the cover element, wherein the first sheet section is connected to a second sheet section of the cover element so as to face away from the combustion chamber. In this solution, the second sheet section is also cylindrical such that reshaping inwards results in an overlapping or folded double layer.

SUMMARY OF THE INVENTION

The object of the invention is to improve a heating device of the type mentioned at the start. In particular, it is intended to create an opening with a very rigid contact area for the burner device, despite the use of a relatively thin-walled sheet.

This object is achieved with a heating device of the type mentioned at the start by the features according to the invention.

According to the invention, it is therefore envisaged that the second sheet section extends radially outwards (starting from the first sheet section) as a contact flange for the burner device.

In other words, the solution according to the invention is thus characterized in that a particularly rigid contact flange is created as a result of an angular (i.e. not parallel), in particular rectangular, arrangement of the two sheet sections relative to one another.

Other advantageous further developments of the heating device according to the invention result from the dependent claims.

BRIEF DESCRIPTION OF THE DRAWINGS

The heating device according to the invention including its advantageous further developments according to the dependent claims are explained in more detail below using the graphic representation of a preferred exemplary embodiment.

In the figures

DETAILED DESCRIPTION OF THE PREFERRED EMBODIMENTS

Figure 1:
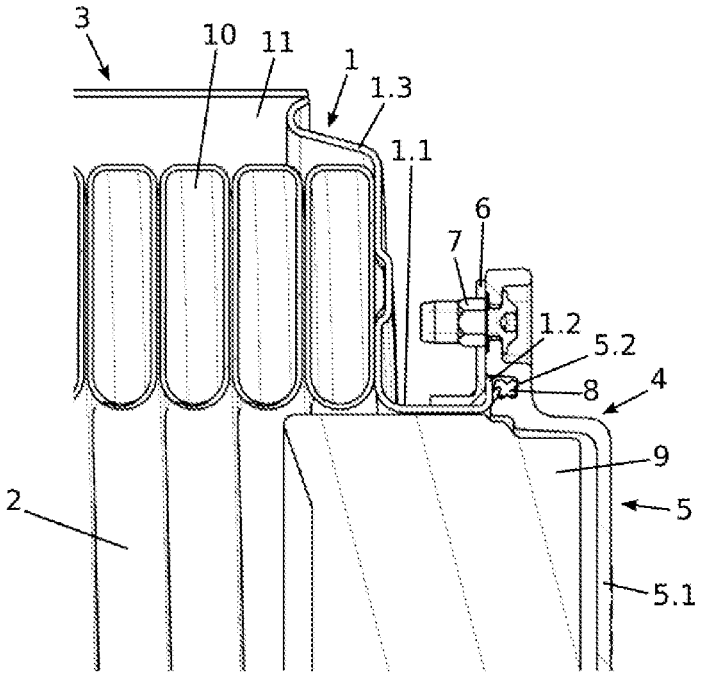
FIG. 1 shows an enlarged section of the contact flange of the heating device according to the invention as shown in FIG. 2.
Figure 2:
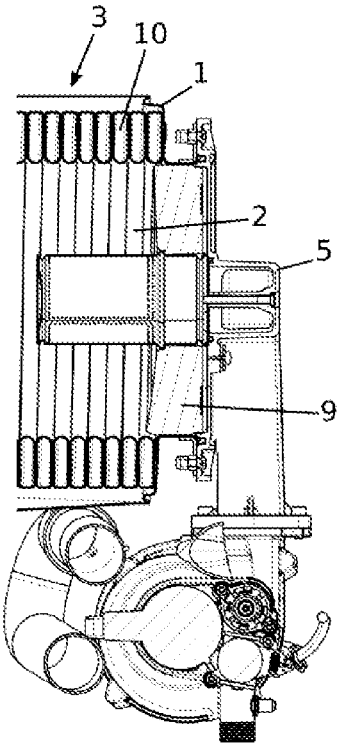
FIG. 2 shows a sectional view of part of the heating device.

The heating device illustrated in the figures initially consists, in a way known per se, of a housing 3 closed with (at least) a cover element 1 and enclosing a combustion chamber 2, wherein an opening 4 for receiving a burner device 5 (preferably for the combustion of a fluid fuel such as gas or oil) pointing into the combustion chamber 2 is provided on the cover element 1, wherein the opening 4 is delimited by a first cylindrical, particularly preferably circular-cylindrical sheet section 1.1 of the cover element 1, wherein the first sheet section 1.1 is connected to a second sheet section 1.2 of the cover element 1 so as to face away from the combustion chamber.

Furthermore, it is, as illustrated, preferably envisaged that a preferably helical heat exchanger 10 enclosing the combustion chamber 2 is arranged in the housing 3.

In addition, it is preferably envisaged that the housing 3 is formed with an exhaust gas jacket space 11 and this surrounds the heat exchanger 10 enclosing the combustion chamber 2.

Figure 4:
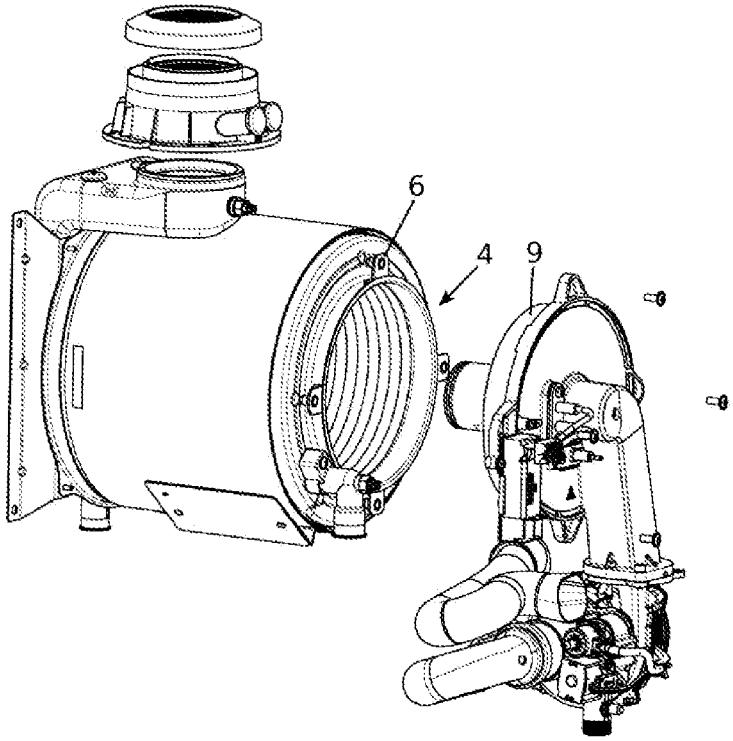
FIG. 4 shows the heating device in perspective and as an exploded view as shown in FIG. 2.

Furthermore, it is preferably envisaged, as can be seen in FIG. 4, that the opening 4 has a circular cross-sectional area.

Figure 3:
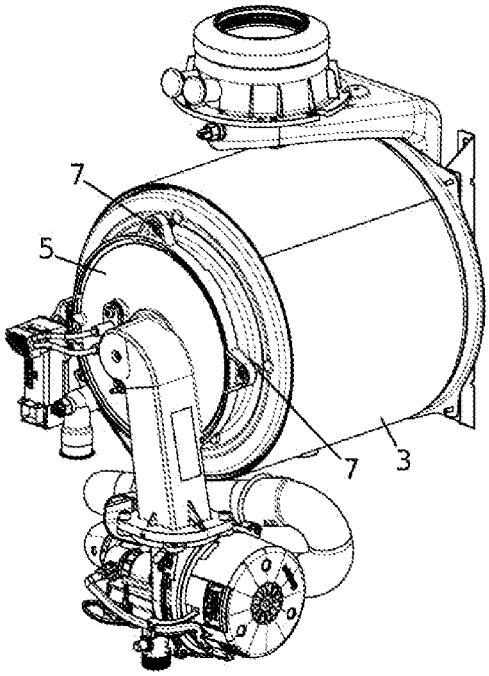
FIG. 3 shows the assembled heating device in perspective as shown in FIG. 2.

Moreover, it is preferably envisaged, as can be seen in FIGS. 3 and 4, that the burner device 5 is designed like a cover in order to close the opening 4. In more detail, it is particularly preferably envisaged that the burner device 5 has a cover-like base body 5.1 Other elements such as a burner blower or a mixing device are then attached to this base body 5.1.

Furthermore, for anti-corrosion purposes, it is preferably envisaged that the two sheet sections 1.1, 1.2 and/or the housing 3 are optionally formed from a stainless steel sheet.

It is now essential for the heating device according to the invention that the second sheet section 1.2 extends radially outwards as a contact flange for the burner device 5. As already mentioned at the start, this measure leads to a particularly high level of rigidity of the contact flange, against which the burner device 5 or its base body 5.1 is braced, even when using comparatively thin-walled material.

As can be seen particularly clearly in FIG. 1, it is particularly preferably envisaged that an elastic sealing ring 8 interacting with the second sheet section 1.2 is arranged on the burner device 5 in order to seal the combustion chamber 2. In more detail, it is preferable to provide an annular groove 5.2 on the burner device 5 for receiving the sealing ring 8.

Furthermore, it is particularly preferably provided that the first cylindrical sheet section 1.1 is at least 10 mm long in the direction of its cylinder axis, preferably more than 15 mm long. This requirement has the advantage that the second sheet section 1.2 is arranged relatively far from the combustion chamber 2 and thus little heat is transferred to the sealing ring 8 to be protected from high temperatures.

In addition, it is particularly preferably envisaged that the second sheet section 1.2 optionally extends at least 5 mm and/or at most 25 mm in a radial direction between its free end and the first sheet section 1.1. In this way, the cover element 1 can easily be made stable.

Furthermore, it follows from the previous explanations that the second sheet section 1.2 is preferably annular.

Furthermore, it is particularly preferably envisaged that the first cylindrical sheet section 1.1 is arranged between the second sheet section 1.2 and a third sheet section 1.3 extending to the housing 3.

As can be seen particularly clearly in FIG. 1, it is preferably envisaged that the heat exchanger 10 rests against the third sheet section 1.3. In addition, it is preferably envisaged that the housing 3 and the third sheet section 1.3 are welded together.

Considered as a whole, it is further preferably envisaged that the three sheet sections 1.1, 1.2, 1.3 are formed from one piece of sheet metal by sheet metal forming.

When fixing the burner device 5, in order to avoid having to apply forces to the third sheet section 1.3, which as mentioned, is important for the arrangement of the heat exchanger, it is further particularly preferably envisaged that (at least) an abutment element 6 for the burner device 5 is optionally arranged on the first cylindrical sheet section 1.1 and/or on the second sheet section 1.2.

In more detail, it is preferably envisaged that the abutment element 6 interacts with the burner device 5, preferably with the base body 5.1.

In addition, it is preferably envisaged that the second sheet section 1.2 is arranged between the abutment element 6 and the burner device 5.

Furthermore, it is particularly preferably envisaged that the burner device 5, preferably the base body 5.1, is firmly, but releasably, connected to the abutment element 6 by means of a screw (for example, as illustrated, with a machine screw) or clamping connection (for example, not illustrated in addition, as a bayonet lock) 7. In this case, the abutment element 6 is particularly preferably, as shown in FIG. 1, designed as an L-shaped angle plate. In the embodiment illustrated, four of these angle plates are provided (see in particular FIG. 4).

In order to further protect the sealing ring 8, it is further preferably envisaged that the burner device 5 is provided with a thermal insulation body 9 facing the combustion chamber 2 and arranged at least partly in the region of the first cylindrical sheet section 1.1 and having a cylindrical outer contour with a thermal insulation body cylinder diameter. It is further particularly preferably envisaged that the first cylindrical sheet section 1.1 has a sheet section cylinder inner diameter that is only slightly larger than or equal to the thermal insulation body cylinder diameter. As a result, there is therefore only a very narrow gap (preferably at most 2 mm, particularly preferably at most 1 mm, very particularly preferably at most 0.5 mm) between the first cylindrical sheet section 1.1 and the thermal insulation body 9, which results in only very little, if any, hot exhaust gas reaching the region of the second sheet section 1.2 and thus the sealing ring 8.

As a further measure to protect the sealing ring 8, it is further preferably envisaged that the combustion chamber 2, which as mentioned above, is enclosed by the heat exchanger 10, is at least partly cylindrical and has a combustion chamber cylinder inner diameter. Finally, it is particularly preferably envisaged that the first cylindrical sheet section 1.1 has a sheet section cylinder inner diameter that corresponds to the combustion chamber cylinder inner diameter. A thermal insulation body 9 protruding into the combustion chamber 2 thus forms, as can be particularly clearly seen in FIG. 1, together with the heat exchanger 10 a further barrier for the hot exhaust gas, which should not reach the sealing ring 8, as far as possible.

REFERENCE LIST

1 Cover element
1.1 First sheet section
1.2 Second sheet section
1.3 Third sheet section
2 Combustion chamber
3 Housing
4 Opening
5 Burner device
5.1 Base body
5.2 Groove
6 Abutment element
7 Screw or clamping connection
8 Sealing ring
9 Thermal insulation body
10 Heat exchanger
11 Exhaust gas jacket space

The invention claimed is:

1. A heating device, comprising a housing (3) closed with a cover element (1) and enclosing a combustion chamber (2), wherein an opening (4) for receiving a burner device (5) pointing into the combustion chamber (2) is provided on the cover element (1), wherein the opening (4) is delimited by a first cylindrical sheet section (1.1) of the cover element (1), wherein the first sheet section (1.1) is connected to a second sheet section (1.2) of the cover element (1) so as to face away from the combustion chamber, wherein the second sheet section (1.2) extends radially outwards as a contact flange for the burner device (5), and wherein the first cylindrical sheet section (1.1) and the second sheet section (1.2) are arranged at an angle to each other so as to be nonparallel.

2. The heating device according to claim 1, wherein the first cylindrical sheet section (1.1) is at least 10 mm long in the direction of its cylinder axis.

3. The heating device according to claim 1, wherein the second sheet section (1.2) optionally extends at least 5 mm and/or at most 25 mm in a radial direction between its free end and the first sheet section (1.1).

4. The heating device according to claim 1, wherein the second sheet section (1.2) is annular.

5. The heating device according to claim 1, wherein the first cylindrical sheet section (1.1) is arranged between the second sheet section (1.2) and a third sheet section (1.3) extending to the housing (3).

6. The heating device according to claim 1, wherein an abutment element (6) for the burner device (5) is optionally arranged on the first cylindrical sheet section (1.1) and/or on the second sheet section (1.2).

7. The heating device according to claim 6, wherein the second sheet section (1.2) is arranged between the abutment element (6) and the burner device (5).

8. The heating device according to claim 6, wherein the burner device (5) is firmly, but releasably, connected to the abutment element (6) by means of a screw or clamping connection (7).

9. The heating device according to claim 1, wherein an elastic sealing ring (8) interacting with the second sheet section (1.2) is arranged on the burner device (5).

10. The heating device according to claim 1, wherein the burner device (5) is provided with a thermal insulation body (9) facing the combustion chamber (2) and arranged at least partly in the region of the first cylindrical sheet section (1.1) and having a cylindrical outer contour with a thermal insulation body cylinder diameter, wherein the first cylindrical sheet section (1.1) has a sheet section cylinder inner diameter that is only slightly larger than or equal to the thermal insulation body cylinder diameter.

11. A heating device, comprising a housing (3) closed with a cover element (1) and enclosing a combustion chamber (2), wherein an opening (4) for receiving a burner device (5) pointing into the combustion chamber (2) is provided on the cover element (1), wherein the opening (4) is delimited by a first cylindrical sheet section (1.1) of the cover element (1), wherein the first sheet section (1.1) is connected to a second sheet section (1.2) of the cover element (1) so as to face away from the combustion chamber, wherein the second sheet section (1.2) extends radially outwards as a contact flange for the burner device (5), and wherein the first cylindrical sheet section (1.1) and the second sheet section (1.2) are arranged at a right angle to each other.

* * * * *